United States Patent [19]

Hagen et al.

[11] 4,324,439

[45] Apr. 13, 1982

[54] ANTI-RACK SYSTEM FOR WIDE DRAWERS AND THE LIKE

[75] Inventors: Magnus F. Hagen, Laguna Beach; Richard O. Rask, Whittier, both of Calif.

[73] Assignee: Standard Precision, Inc., Santa Fe Springs, Calif.

[21] Appl. No.: 111,121

[22] Filed: Jan. 10, 1980

[51] Int. Cl.[3] ..... F16C 29/04

[52] U.S. Cl. ..... 308/3.8; 312/341 R

[58] Field of Search ..... 308/3.8, 3.6, 6 R; 312/341 R, 342, 343, 344

[56] References Cited

U.S. PATENT DOCUMENTS

| | | | |
|---|---|---|---|
| 3,722,964 | 3/1973 | Chitester et al. | 308/3.8 |
| 3,857,618 | 12/1974 | Hagen et al. | 308/3.8 |
| 3,912,341 | 10/1975 | Stein | 312/341 R |

*Primary Examiner*—Lenard A. Footland

*Attorney, Agent, or Firm*—Francis X. LoJacono

[57] ABSTRACT

A drawer-slide-suspension system adapted for use with comparatively wide suspended drawers or like moving objects, whereby a wide drawer is slidable within a cabinet enclosure without binding or racking when a closing or opening force is applied along any longitudinal portion of the drawer, the system comprising two oppositely disposed slide-suspension mechanisms, each including two slide units, one defined as being a lower substantially stationary cabinet unit, the other being an upper or movable drawer-mounted unit, and having an intermediate member interconnected between the upper and lower units, and further including a synchronizing belt attached between the upper and lower units, a geared wheel being mounted to the rear of each intermediate member, the wheels being operably connected by a longitudinal transverse shaft and arranged to engage respective linear gear racks attached to each stationary unit.

7 Claims, 7 Drawing Figures

ANTI-RACK SYSTEM FOR WIDE DRAWERS AND THE LIKE

BACKGROUND OF THE INVENTION

1. Field of the Invention

This invention relates generally to a drawer-slide mechanism, and more particularly to an anti-rack drawer-slide system to prevent binding, racking or misalignment as a drawer is moved in and out.

2. Description of the Prior Art

As is well known in the art, various problems and difficulties are encountered in providing suitable means for preventing wide drawers from binding or racking while they are being closed or opened. That is, drawers and other slidable objects that are mounted in stationary cabinet members will generally cock to one side or the other when force is applied in opening or closing the drawer or the like.

Various types of slide mechanisms have been developed to overcome this well-establish problem. However, these slide mechanisms are generally positioned on opposite sides of the drawer, and must operate independently of each other. Further, the elements of the slide mechanisms are generally not controlled or synchronized with each other. Thus, care must be taken to open or close the drawer by applying force evenly on both sides in order to prevent binding along one side.

SUMMARY AND OBJECTIVES OF THE INVENTION

The anti-rack system for wide drawers includes a drawer-slide-suspension system comprising two oppositely disposed slide mechanisms secured to the inner sides of a cabinet or like stationary structure. Each mechanism comprises a stationary slide member mounted to the cabinet, a movable slide member mounted to the drawer, and a synchronizing belt attached between the stationary and movable slides forming a part of the mechanism, the purpose of this belt being to maintain the movement of the members in a correct synchronized relationship with each other under all conditions of slide travel.

A geared wheel, such as a spur gear, is mounted on the rear portion of an intermediate member in such a manner as to engage a toothed gear rack attached to or made part of the stationary member, the intermediate member being adapted to move independently with respect to the stationary member and the movable member. The opposing geared wheels are interconnected by a transverse shaft, thereby tying together the oppositely arranged slide mechanisms so that they co-act as a single slide.

Thus, it is an important object of the present invention to provide an anti-rack slide device wherein the oppositely disposed slide mechanisms are tied to each other, thereby preventing any misalignment therebetween during linear movement of the associated drawer.

It is another object of the invention to provide an anti-racking slide system for wide drawers and the like that incorporates a synchronized belt drive, whereby the belt causes the intermediate member to progress at exactly one half the speed and distance of the movable member.

It is still another object of the invention to provide a system of this character wherein the action or motion of one slide is transferred to the opposite slide, causing them to move in synchronization and thus preventing racking or binding of the drawer in the cabinet unit.

It is a further object of the invention to provide a device of this character that has relatively few operating parts to accomplish such a synchronized slide motion.

Still another object of the present invention is to provide a device of this character that is relatively inexpensive to manufacture.

The characteristics and advantages of the invention are further sufficiently referred to in connection with the accompanying drawings, which represent one embodiment. After considering this example, skilled persons will understand that variations may be made without departing from the principles disclosed; and we contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 2 is a cross-sectional view taken substantially along line 2—2 of FIG. 1;

DESCRIPTION OF THE PREFERRED EMBODIMENT

Figures 1, 6, 7:
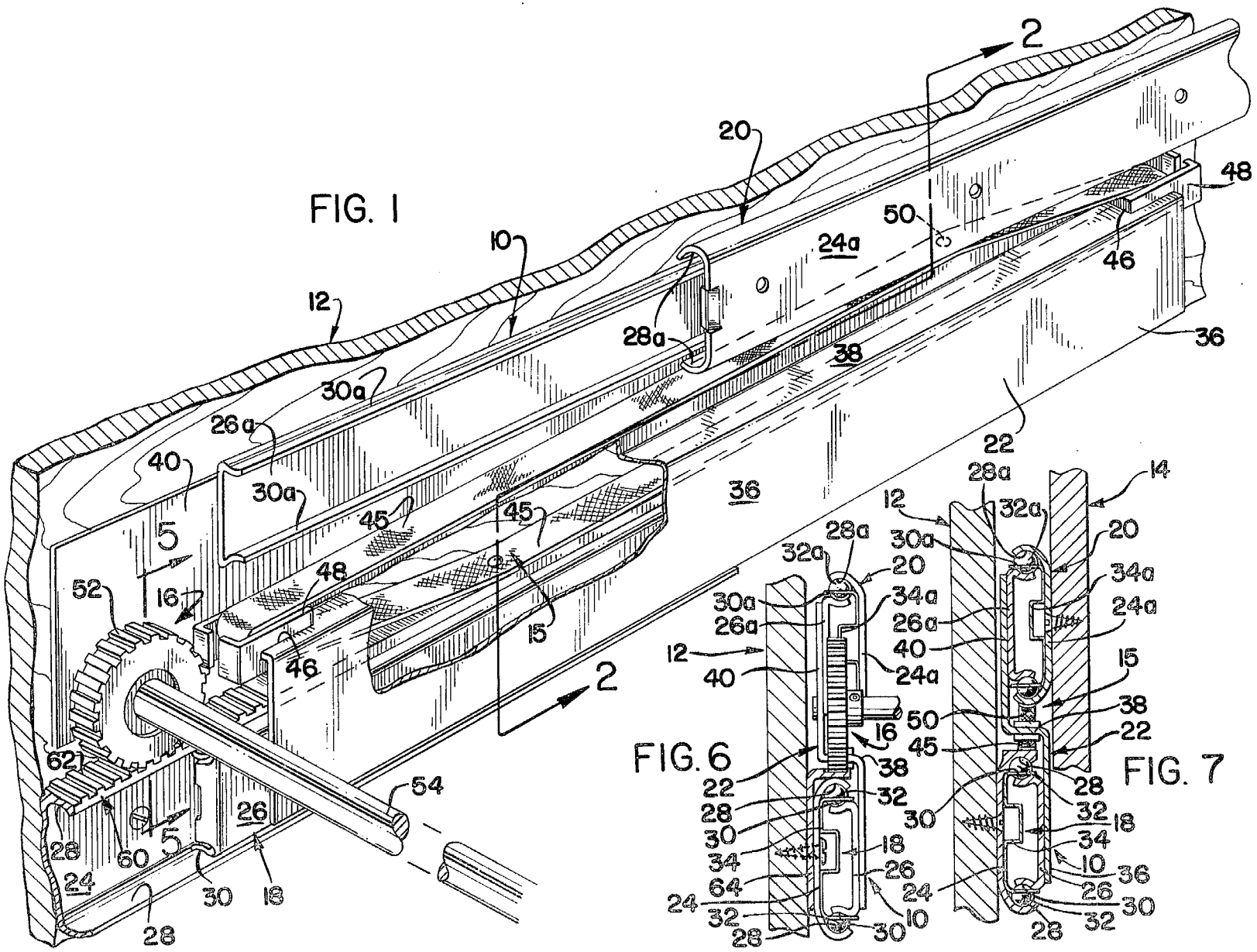
FIG. 1 is a pictorial view of the present invention mounted to a stationary side wall structure.
FIG. 6 is an end view of the slide mechanism showing an alternative arrangement of a separate gear-rack member.
Figure 4:
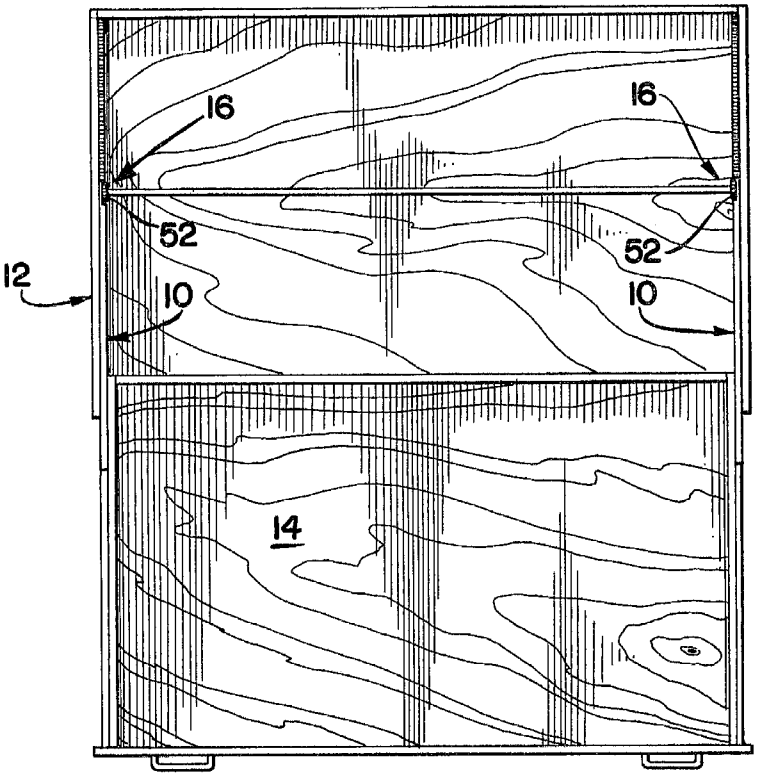
FIG. 4 is a top-plan view of a drawer showing the present invention in an open position within a cabinet.
Figure 3:
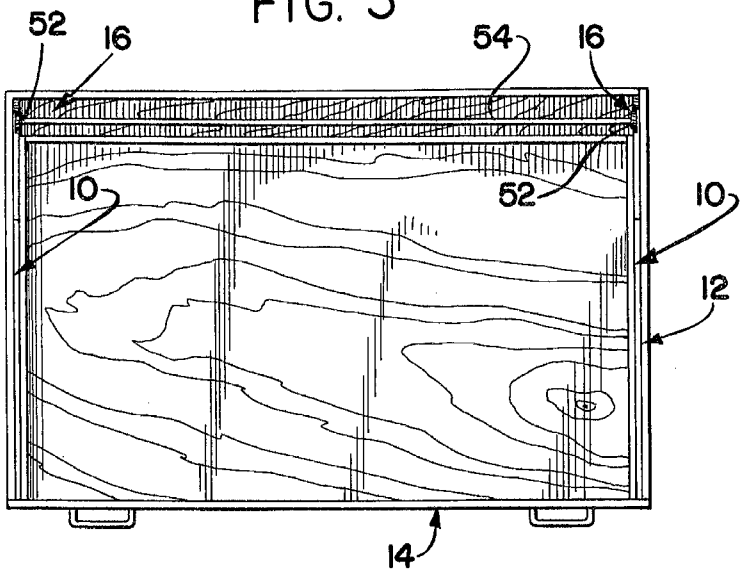
FIG. 3 is a top-plan view of a drawer showing the present invention in a closed position within a cabinet.

Referring more particularly to FIG. 1, there is shown a drawer-slide-suspension mechanism, generally indicated at 10, which is mounted between a fixed structure 12 defined by a cabinet, and a movable structure generally defined by a drawer 14, as seen in FIGS. 3 and 4.

Accordingly, the invention of the anti-rack system includes two such drawer-slide-suspension mechanisms which are oppositely disposed to each other so as to support a drawer 14 on each side thereof in a conventional manner, the oppositely positioned slide mechanisms 10 being operably interconnected by a linear-movement-stabilizing means, generally designated at 16.

Each drawer-slide-suspension mechanism 10 is defined by a pair of telescoping or linear-motion ball-bearing slide units having lower substantially stationary or cabinet slide units 18 and upper or movable drawer-mounted slide units 20. The slide units 18 and 20 are interconnected by an intermediate member 22 that is movable between the upper and lower slide units. Included in each slide mechanism is a synchronizing belt means, generally indicated at 15, to maintain the progressional movement of the associated slide members in a correct relationship with each other under all conditions of slide travel.

Lower slide unit 18 comprises a pair of slide members, one being an outer slide member 24 and the other being an inner slide member 26, each having oppositely arranged, longitudinal, ball-bearing raceways 28 and 30, respectively. The raceways are arranged to receive interpositioned ball bearings 32 which are held in place by a ball-retainer member 34. Thus, the outer or stationary slide member 24 is secured to the fixed structure or cabinet side 12, the inner slide member 26 being allowed to move linearly thereto and being secured to the intermediate member 22. The intermediate member is formed having a lower plate portion 36 to which inner slide 26 is fixedly mounted, an offset portion 38, and an upwardly extending upper plate portion 40 having the inner slide member **26*a* secured thereto. The upper movable slide unit 20 includes inner slide member 26*a* and an outer fixed slide member 24*a*, the outer slide member 24*a* being affixed to the slidable drawer 14. Also provided are a ball-retainer member 34*a* and ball bearings 32*a* which are received in raceways 28*a* and 30*a***.

Accordingly, the in-and-out linear movement of drawer 14 causes outer slide member **24*a* to move with member 14, thereby transmitting movement through ball bearings 32*a* to inner slide 26*a* whereby intermediate member 22 moves with inner slide 26*a*. As intermediate member 22 moves, the lower inner slide member 26 which is affixed thereto will also move longitudinally. However, there can be no irrelation or disunity in the corresponding moving members. Thus, there is further included synchronizing means 15 which provides and maintains a synchronized relationship between the upper and lower slide units and their related moving elements. Synchronizing means 15 comprises a continuous or endless flexible belt or band 45 which is operably looped about the longitudinal offset portion 38 disposed between the oppositely disposed outer slide members 24 and 24*a*. Openings 46 are formed in the opposite ends of offset portion 38 through which the belt or band 45 operably passes. To better facilitate the movement of belt 45 about the intermediate member 22, there is also provided a belt-alignment means defined by bushing members 48 that are positioned within each end opening 46 provided in offset portion 38**.

Band or belt 45 is formed from a strip of flexible material which is fixedly secured to the underside of the upper outer slide member **24*a*, and to the top side of the lower outer slide member 24. The belt can be secured in any suitable manner, but is shown being secured by a rivet 50. Hence, belt 45 is affixed at two points—to the outer stationary slide member 24, and to the outer movable slide member 24*a*—whereby the end loops of the belt engage the respective ends of the intermediate member 38**. Thus, the flexible-band arrangement maintains a synchronized moving relationship between the lower slide unit, the intermediate member, and the upper slide unit.

Figure 5:
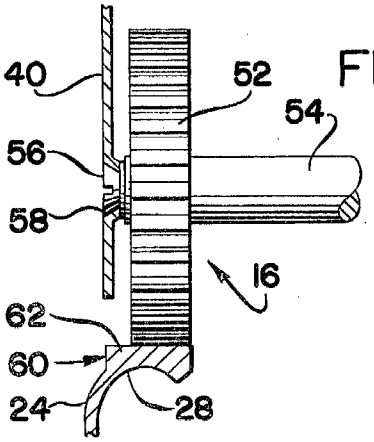
FIG. 5 is an enlarged cross-sectional view of the geared wheel and its associated gear rack formed as part of the stationary slide member.

Interconnecting the oppositely arranged drawer-slide suspension mechanisms is a linear-stabilizing means 16 which comprises a pair of geared wheels 52, each being rotatably mounted to the opposing intermediate member 22, the two geared wheels being connected together through the longitudinal transversely positioned shaft 54. The geared wheels 52 and shaft 54 may be rotatably mounted to plate 40 in any suitable manner, but is shown in FIG. 5 as having a bolt 56 supported in opening 58 of plate 40.

Further included therein is a longitudinally formed rack 60 having a plurality of teeth 62 disposed along the length of the upper raceway 28 of slide member 24. Therefore, as the intermediate member 22 moves back and forth along the fixed slide member 24, the interconnected geared wheels will rotate together, thus preventing misalignment between each opposing slide mechanism 10.

FIGS. 1 and 2 illustrate the teeth 62 of rack 60 as being integrally formed in slide member 24; however, it is contemplated that the rack can be formed as a separate member 64 as shown in FIG. 6, thereby obtaining the same results.

Accordingly, as the lower slide unit 18 is extended or retracted, the belt causes the intermediate member to progress at exactly one half the speed and distance of the inner slide 26. The spur gear 52 which is attached to the intermediate member 22 and engages rack 60 will turn as the drawer member 14 is set in motion. This turning motion is transferred to the opposite gear by means of a shaft 54.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and we do not wish to be restricted to the specific form shown or uses mentioned, except as defined in the accompanying claims.

We claim:

1. An anti-racking apparatus for wide drawers and the like supported within a cabinet structure comprising a pair of slide-suspension mechanisms, each being oppositely positioned on each side of said drawer, wherein each mechanism includes:

a first lower slide unit fixedly mounted to said cabinet structure, wherein said lower slide unit comprises an outer slide member fixedly secured to said cabinet structure, an inner slide member movably supported within said outer slide, and bearing means interposed therebetween;

a second upper slide unit mounted to the side of said drawer and movable therewith, wherein said upper slide unit comprises an outer slide member fixedly secured to said drawer, an inner slide member movably supported within said outer slide member thereof, and bearing means interposed between said outer and inner slide members;

an intermediate member interconnecting said lower and upper slide units together;

a synchronizing means interconnected between said lower and upper slide units to control the relative linear movement therebetween, wherein said outer units of said upper and lower slide units are interconnected by said synchronizing means, and said inner units thereof are interconnected and movable with said intermediate member; and a stabilizing means mounted between said opposing pair of said slide suspension means to establish a parallel linear motion therebetween.

said stabilizing means is operably interconnected to each oppositely disposed intermediate member.

2. An anti-racking apparatus as recited in claim 1, wherein said stabilizing means comprises:

a first geared wheel rotatably attached to the rear of one of said intermediate members;

a second geared wheel rotatably attached to the rear of the other oppositely disposed intermediate member;

a shaft transversely disposed and interconnecting said geared wheels, whereby said geared wheels will rotate together with said shaft; and a gear rack affixed to each of said outer slide members of said lower slide units, whereby said geared wheels engage respective gear racks.

3. An anti-racking apparatus as recited in claim 2, wherein said stabilizing means comprises:

a continuous flexible belt member fixedly secured to the upper outer slide member and to the lower outer slide member, said belt member forming a continuous loop longitudinally about said intermediate member so as to engage said intermediate member, whereby a linear synchronized movement is established between said lower and upper slide units.

4. An anti-racking apparatus as recited in claim 3, wherein said gear rack is integrally formed along the upper longitudinal surface of each lower outer slide member.

5. An anti-racking apparatus as recited in claim 3, wherein said gear rack is formed as a separate member secured to said lower outer slide member and positioned to engage said geared wheel member.

6. An anti-racking apparatus for wide drawers and the like supported within a cabinet structure comprising a pair of slide-suspension mechanisms, each being oppositely positioned on each side of said drawer, wherein each mechanism includes:

a first lower slide unit fixedly mounted to said cabinet structure, wherein said lower slide unit comprises an outer slide member fixedly secured to said cabinet structure, an inner slide member movably supported within said outer slide, and bearing means interposed therebetween;

a second upper slide unit mounted to the side of said drawer and movable therewith, wherein said upper slide unit comprises an outer slide member fixedly secured to said drawer, an inner slide member movably supported within said outer slide member thereof, and bearing means interposed between said outer and inner slide members;

an intermediate member interconnecting said lower and upper slide units together;

a synchronizing means interconnected between said lower and upper slide units to control the relative linear movement therebetween;

said outer units of said upper and lower slide units being interconnected by said synchronizing means, and said inner units thereof being interconnected and movable with said intermediate member;

said intermediate member comprising an upper plate portion fixedly secured to said inner slide member of said upper slide unit, a lower plate portion fixedly secured to said inner slide member of said lower slide unit, whereby said uuper and lower slide members move with said intermediate member, and a longitudinal off-set portion arranged for engagement with said synchronizing means, wherein said synchronizing means comprises a continuous flexible belt member looped about said longitudinal off-set portion of said intermediate member for operable engagement therewith, said belt being fixedly secured to said outer slide member of said lower slide unit and further secured to said outer slide member of said upper slide unit;

a stabilizing means mounted between said opposing pair of said slide suspension means to establish a parallel linear motion therebetween.

7. An anti-rack apparatus as recited in claim 6, wherein said stabilizing means comprises:

a longitudinal gear rack associated with each of said oppositely disposed outer slide members of said lower slide units;

a pair of geared wheels operably mounted to the rear of said intermediate members and positioned to engage said respective gear racks; and a transversely disposed shaft connected to each of said geared wheels for rotational movement therewith, whereby said geared wheels move in parallel relation to each other.

* * * * *